US011476563B2

(12) United States Patent
Ortigosa

(10) Patent No.: US 11,476,563 B2
(45) Date of Patent: Oct. 18, 2022

(54) UNDER-ROOF ANTENNA MODULES FOR VEHICLE

(71) Applicant: Advanced Automotive Antennas, S.L.U., Barcelona (ES)

(72) Inventor: Enrique Martinez Ortigosa, Barcelona (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 342 days.

(21) Appl. No.: 16/457,303

(22) Filed: Jun. 28, 2019

(65) Prior Publication Data

US 2020/0006844 A1 Jan. 2, 2020

(30) Foreign Application Priority Data

Jun. 29, 2018 (EP) ..... 18382483

(51) Int. Cl.
*H01Q 1/32* (2006.01)

(52) U.S. Cl.
CPC ..... *H01Q 1/3275* (2013.01); *H01Q 1/3241* (2013.01)

(58) Field of Classification Search
CPC ..... H01Q 1/3241; H01Q 1/48; H01Q 1/3275; H01Q 1/3291; H01Q 21/28
See application file for complete search history.

(56) References Cited

U.S. PATENT DOCUMENTS 5,438,338 A * 8/1995 Thill ..... H01Q 1/1285 343/860
5,982,333 A * 11/1999 Stillinger ..... H01Q 3/08 342/359
6,069,589 A * 5/2000 Lewis, Jr. ..... H01Q 21/28 343/770
6,087,990 A * 7/2000 Thill ..... H01Q 21/28 343/700 MS
6,249,242 B1 * 6/2001 Sekine ..... H01L 23/66 342/175
6,850,191 B1 * 2/2005 Thill ..... H01Q 5/40 343/700 MS
8,159,403 B1 * 4/2012 Chen ..... H01Q 21/205 343/705
9,379,437 B1 * 6/2016 Stutzke ..... H01Q 3/36
9,966,659 B2 5/2018 Chakam et al.
2005/0014539 A1 * 1/2005 Koshizaka ..... H01Q 23/00 343/702

(Continued)

FOREIGN PATENT DOCUMENTS

DE 102009038150 A1 * 3/2011 ..... H01Q 1/325
EP 3588673 A1 * 1/2020 ..... H01Q 1/3241

(Continued)

OTHER PUBLICATIONS

Extended European Search Report for European Application No. 18382483.8; Date of Completion: Nov. 20, 2018; dated Nov. 28, 2018; 7 Pages.

*Primary Examiner* — Graham P Smith
*Assistant Examiner* — Jae K Kim
(74) *Attorney, Agent, or Firm* — Cantor Colburn LLP

(57) ABSTRACT

An under-roof antenna module for a vehicle includes a metallic frame with at least one perforation, and at least one transceiver. The at least one transceiver is arranged at portions of the frame proximal to the at least one perforation.

14 Claims, 9 Drawing Sheets

(56) References Cited

U.S. PATENT DOCUMENTS

2006/0244573 A1* 11/2006 Wendler ..... G08G 1/20 340/333
2010/0052986 A1* 3/2010 Nink ..... H01Q 21/29 342/372
2011/0080323 A1* 4/2011 Thiam ..... H01Q 5/40 343/700 MS
2011/0187614 A1* 8/2011 Kirino ..... G01S 7/032 333/239
2012/0038525 A1* 2/2012 Monsalve Carcelen ..... H01Q 1/286 343/705
2013/0082879 A1* 4/2013 Fuchs ..... H01Q 5/328 343/700 MS
2013/0341414 A1* 12/2013 Ziller ..... H01Q 5/40 235/492
2014/0361932 A1* 12/2014 Irei ..... H01Q 21/28 343/702
2015/0078422 A1* 3/2015 Shen ..... H04B 1/40 375/219
2015/0138020 A1* 5/2015 Khobragade ..... H01Q 21/28 343/702
2016/0195612 A1* 7/2016 Shi ..... H01Q 21/005 342/27
2016/0197398 A1* 7/2016 Scheim ..... H01Q 1/286 343/713
2017/0141476 A1* 5/2017 Kim ..... H01Q 1/3275
2017/0301996 A1* 10/2017 Desclos ..... H01Q 1/36
2018/0090847 A1* 3/2018 Romano ..... H01Q 9/0414
2019/0372198 A1* 12/2019 Dalmia ..... H01L 23/66
2019/0372229 A1* 12/2019 Dalmia ..... H01Q 1/085
2020/0303805 A1* 9/2020 Ryoo ..... H01Q 21/28

FOREIGN PATENT DOCUMENTS

WO 0247198 A2 6/2002
WO 2004030143 A1 4/2004

* cited by examiner

UNDER-ROOF ANTENNA MODULES FOR VEHICLE

CROSS-REFERENCE TO RELATED APPLICATIONS

This patent application claims priority to European Provisional Patent Application No. 18382483.8, filed Jun. 29, 2018, which is incorporated herein by reference in its entirety.

INTRODUCTION

The present disclosure relates to antenna modules, and more particularly, to under-roof antenna modules for vehicles.

A typical vehicle may host antennas for various wireless technologies, such as telephony (up to 4 antennas if Multiple Input Multiple Output (MIMO) antennas are used), global navigation satellite system (GNSS), Satellite Digital Audio Radio Service (SDARS), Remote Key Entry (RKE), AM/FM/Digital Audio Broadcasting (DAB) etc. The number of antennas that may possibly be hosted in a vehicle is increasing with time. Traditionally, antennas are integrated in different locations of a vehicle. Such locations may vary. Example locations include the external rear view mirror, the Shark fin, the windscreen, the bumpers, the rain sensor position, the dashboard etc.

The exterior view mirror is an external element of the car. Its available area is generally limited. Changes in the mirror design often imply an antenna redesign. As for the shark fin, this location is used mostly for telephony and GNSS. However, it is a visible location, and furthermore the available area is limited so, for instance, it is not feasible to implement a 4×4 MIMO antenna solution in the shark fin. With respect to the dashboard, it is mainly used for telephony, GNSS and RKE. However, performance of the antennas in the dashboard can be degraded if a thermal layer is used and especially for GNSS antennas because the GNSS antenna diagram pattern is pointing to the zenith (towards the GNSS satellites in the sky).

It is desirable to provide a solution for integrating various antennas at a single position of the vehicle to overcome at least some of the aforementioned issues.

SUMMARY

In a first aspect, an under-roof antenna module for a vehicle is proposed. The under-roof antenna module comprises a metallic frame with at least one perforation, at least one transceiver, arranged at portions of the frame proximal to the at least one perforation.

An under-roof antenna module may be defined as any antenna module that may be embedded between an external curve (e.g. roof, hood, or trunk) and an internal profile of the vehicle. Thus, the antenna module may not be visible from the outside, contrary to antenna modules embedded in antenna fins, and may also not be visible from the inside of the vehicle. The metallic frame may form part of the vehicle's structure or may be attached to the vehicle's structure. In any case, the connection between the metallic frame and the vehicle's structure may be configured to maintain the electrical continuity between both elements.

A position at which the at least one transceiver is arranged with respect to the perforations has an important effect on the performance of the transceiver. By providing the at least one transceiver at portions of the frame proximal to the perforations, it is possible to maximize such performance of the at least one transceiver. Particularly, for a similar transceiver's frequency, it has been found that with a decreasing distance between the transceiver and the perforation, the Voltage Standing Wave Ratio (VSWR) may be decreased such that the Voltage Standing Wave Ratio (VSWR) is situated in a desirable range of operation values.

It is noted that the smaller the VSWR is, the better the transceiver is matched to a transmission line and more power is delivered to the receiver. The minimum VSWR is 1.0. In this case, no power is reflected from the antenna, which is ideal.

In some examples, the at least one transceiver comprises one or more terrestrial communication transceivers, such as cellular telephony antennas. In some examples the cellular telephony antennas may be configured to be operable with Long Term Evolution (LTE) frequencies.

In some examples, the under-roof antenna module may further comprise at least a second transceiver, arranged at portions of the frame distal to the perforations. In examples, the second transceiver comprises satellite antennas. In further examples, the satellite antennas are configured to be operable for receiving satellite digital audio radio services (SDARS) signals and or global navigation satellite system (GNSS) signals.

By providing the at least one transceiver at portions of the frame proximal to the perforations, and the at least second transceiver, arranged at portions of the frame distal to the perforations, it is possible to increase the efficiency of the reception by providing a MIMO system which sends and receives signals using multiple transceivers.

For example, as commented above, the at least one transceiver may comprise terrestrial communication transceivers, such as cellular communication antennas, where the transceiver's diagram pattern has a maximum of radiation at lower elevations whereas the at least second transceiver may comprise satellite transceivers, e.g. GNSS antennas, where the maximum of radiation is expected to be at the zenith pointing to the sky. Thus, terrestrial communication antennas may be provided at portions of the frame proximal to the perforations or holes whereas satellite antennas may be provided at portions of the frame distal to the holes as the presence of the holes is not required In some examples, the under-roof antenna module may be configured to be placed in a cavity or recession of a roof portion of the vehicle. This allows for seamless integration of the antenna module in the shape of the roof of the vehicle.

In some examples, the metallic frame may be integrated with the roof portion of the vehicle. Thus, no additional piece may be required, and the frame may form part of the chassis of the roof of the vehicle.

In some examples, the under-roof antenna module may further comprise a support base, attached to the frame, wherein the first and second set of antennas are arranged along the support base. The base may allow for easier placement of the antennas along the frame.

In some examples, the metallic frame may have an elongated form along a main direction and a series of perforations along the main direction. The main direction may be parallel or transversal to a direction of movement of the vehicle.

By providing the antenna module in a cavity it is possible to integrate all antennas in a single location and maximize isolation by distributing the antennas along the elongated base. Furthermore, by providing the cavity in a top part of the vehicle, the antennas may be invisible and interference with other electronic parts of the vehicle or with other devices in the interior of the vehicle may be minimized.

In some examples, the elongated metallic frame may comprise three perforations or holes distributed along the elongated form. One central perforation may be towards the center of the frame and two extreme perforations on opposite sides of the central perforation may be towards the edges of the elongated frame.

In some examples, a first cellular telephony antenna may be attached at an edge of an extreme perforation; a second cellular telephony antenna may be attached at an edge of the other extreme perforation and a third and fourth telephony antennas may be attached at a first and second edge of the central perforation, respectively.

In some examples, the under-roof antenna module may further comprise a Satellite DARS (SDARS) antenna, arranged on top of one of the first or second cellular telephony antennas. SDARS antennas have a different radiation pattern than telephony antennas (e.g. LTE MIMO antennas). SDARS antennas may demonstrate a hemispherical pattern for communication to Satellites whereas Telephony antennas may demonstrate an omnidirectional pattern for communication at lower elevation angles towards terrestrial Telephony Base Stations. Due to the antenna pattern behavior, even if the SDARS antenna is close to the telephony antenna, a high level of isolation is obtained between them.

In some examples, the under-roof antenna module may further comprise a remote keyless entry (RKE) antenna attached to another edge of one of the extreme perforations.

In some examples, the GNSS antenna may be attached to the frame in a space between one of the extreme perforations and the central perforation.

In some examples, the perforations may comprise a rectangular shape, each having a first dimension of between 95 and 200 mm along the main direction and a second dimension of between 50 mm and 110 mm in a direction perpendicular to the main direction, respectively.

BRIEF DESCRIPTION OF THE DRAWINGS

Other features, advantages and details appear, by way of example only, in the following detailed description, the detailed description referring to the drawings in which.

DETAILED DESCRIPTION

The following description is merely exemplary in nature and is not intended to limit the present disclosure, its application or uses.

Figure 1A:
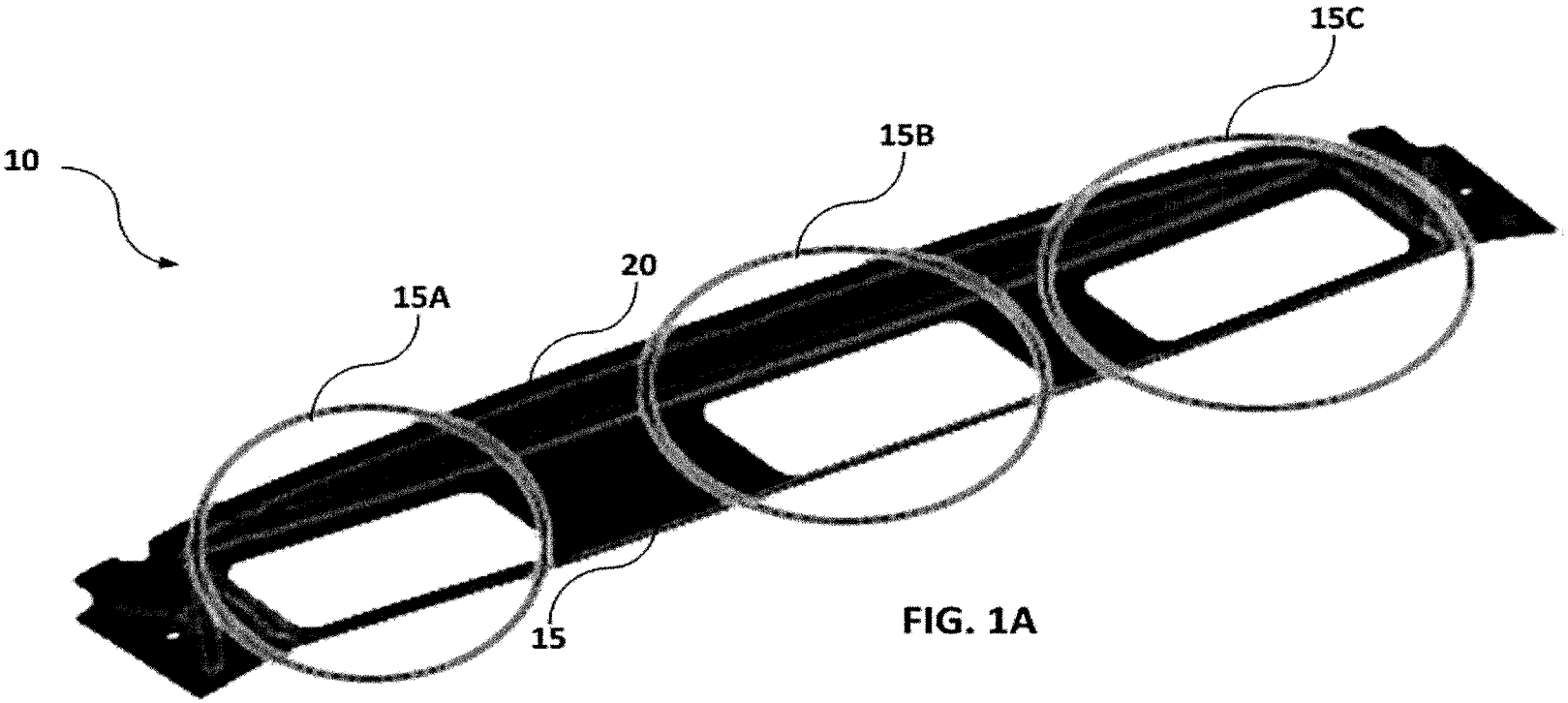
FIG. 1A schematically illustrates a frame for an under-roof module according to an example.

FIG. 1A schematically illustrates a frame for an under-roof module according to an example. Frame 10 may have an elongated form and may comprise a first part 15 and a second part 20. The two parts may define two profile steps at different levels. One level may correspond to a recession level of a roof of a vehicle and the other level may correspond to the roof level of the vehicle. The elongated frame may be configured to be mounted in a cavity of the vehicle part, e.g. roof, hood (bonnet), trunk (boot) of a vehicle. The height difference between the two levels may be selected to allow for the collocation of one or more transceivers on the lower level along the frame. The first part 15 may comprise perforations or holes 15A, 15B and 15C. The perforations may be substantially rectangular.

Figure 1B:
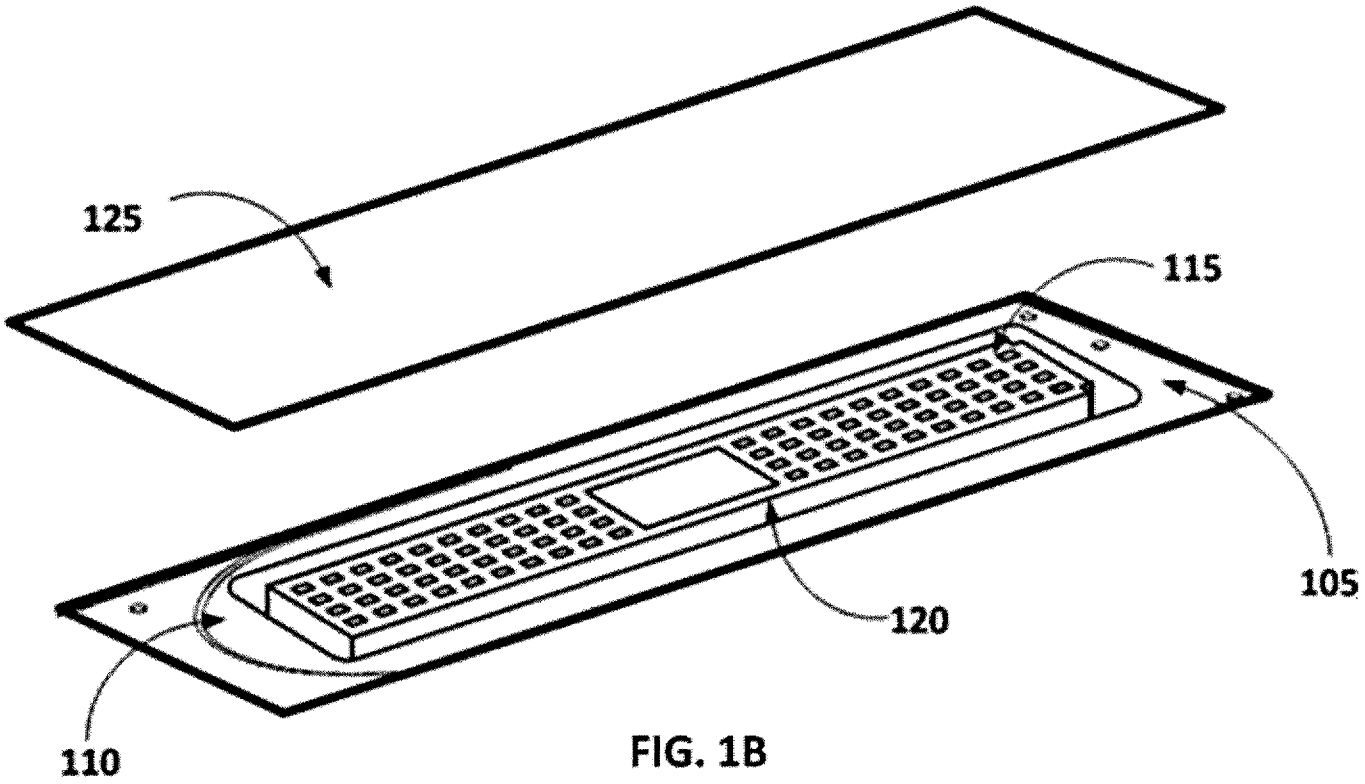
FIG. 1B schematically illustrates an antenna module integrated in a cavity of a top part of a vehicle, according to an example.

FIG. 1B schematically illustrates an antenna module integrated in a cavity of a top part of a vehicle, according to an example. The vehicle (not shown) may comprise a top part 105. The top part 105 may comprise a cavity 110. The cavity 110 may be sized to host an antenna module 115. The antenna module 115 may comprise an elongated base 120. The elongated base 120 may comprise a plurality of antennas distributed along the elongated base 120. The elongated base 120 may be sitting on a perforated frame, such as frame 10. A cover 125 may conceal the antenna module 115 in the cavity and provide protection to the antenna module 115 from external factors, e.g. weather, moisture etc. The cover 125 may be plastic or made of glass, e.g. dark glass, and not from metal, so as to provide non-dielectric properties. The antenna module may be coupled (e.g. using a bayonet type mount) to a metallic base. Alternatively, it may be adhered, e.g. glued, to the metallic base. The metallic base may then be attached (e.g. screwed) to the vehicle's frame (chassis). The metallic base may provide grounding for the antenna module's antennas. The metallic base may comprise holes or openings that provide contact points between the antenna module and the vehicle frame.

Figure 2:
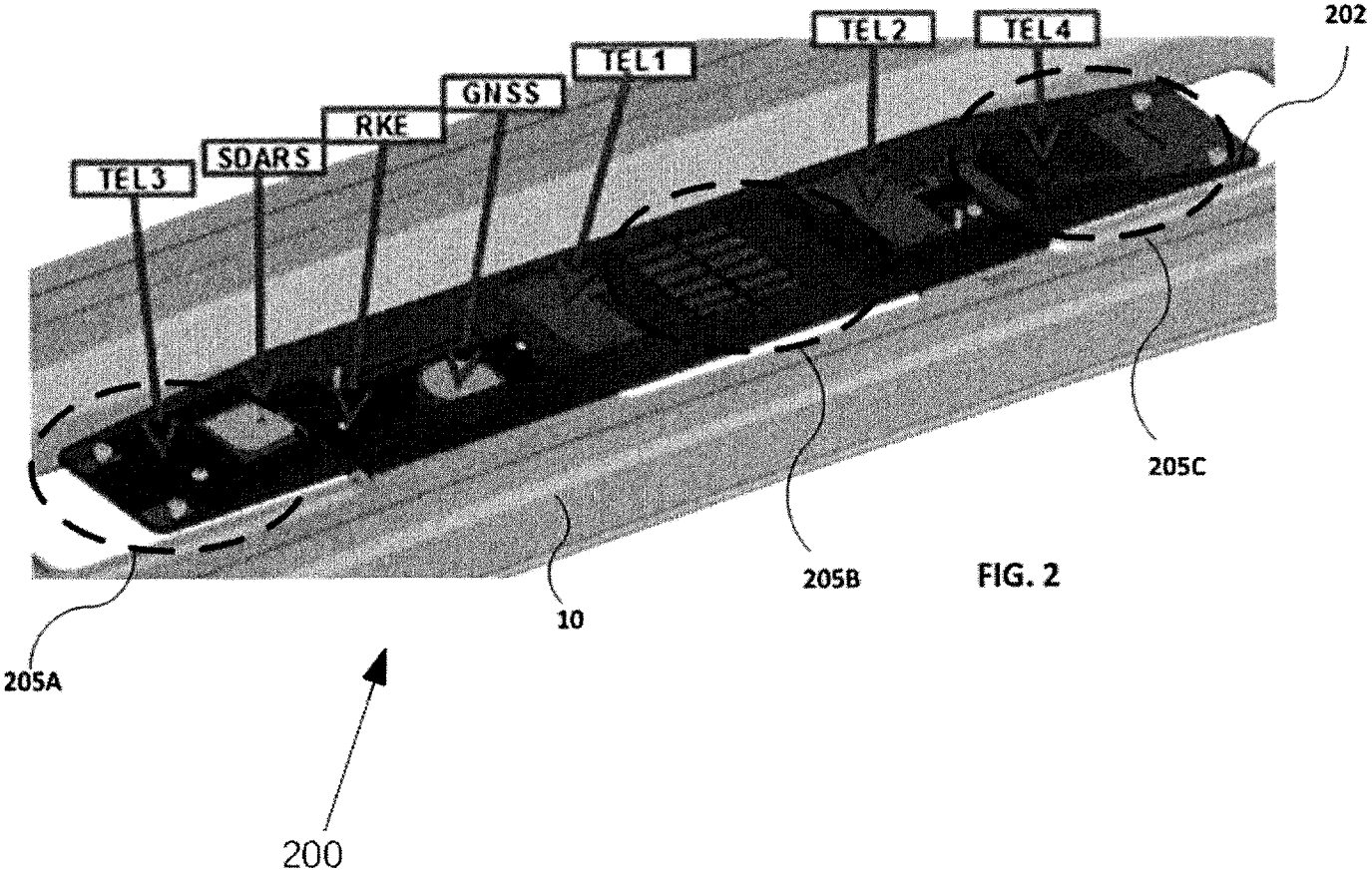
FIG. 2 schematically illustrates an under-roof module, according to an example.

FIG. 2 schematically illustrates an under-roof module 200 according to an example. The under-roof module may comprise a frame 10, a base 202 to support the antennas, a first set of transceivers (TEL1-TEL4) and a second set of transceivers (SDARS, GNSS, RKE). The frame 10 may have an elongated form, substantially similar to the frame discussed with reference to FIG. 1A, and the base may be distributed along the elongated frame. The first set of transceivers may comprise terrestrial communication transceivers and the second set of transceivers may comprise satellite communication transceivers. The first set of transceivers may comprise one or more multiple-input multiple-output (MIMO) mobile communications antennas and the second set may be configured to be operable for receiving at least satellite signals such as global navigation satellite system (GNSS) signals and satellite digital audio radio services (SDARS) signals. GNSS may refer to any satellite navigation system, such as Global Positioning System (GPS), the Global Navigation Satellite System (GLONASS) or Galileo. The GNSS antenna may be first (GNSS-1) or second (GNSS-2) generation GNSS antennas. It may, therefore, use either first- or second-generation frequency bands. More specifically, for GNSS-2, the GNSS antenna may use L1 and L2 frequencies of the L frequency band (1 to 2 GHz range of the radio spectrum). However, the GNSS antennas used as part of the present disclosure may use other or further frequencies of the L band (e.g. L5) or other bands of the radio spectrum as GNSS systems are developing.

The MIMO antennas may be operable over multiple frequency bands, including LTE (Long Term Evolution) frequencies (e.g., 5G, 4G, 3G, another LTE generation, B17

(LTE), LTE (700 MHz), etc.). In one example, the one or more MIMO antennas may include a first or primary cellular antenna and a second or secondary cellular antenna. The first cellular antenna may be configured to be operable for both receiving and transmitting communication signals within one or more cellular frequency bands (e.g., LTE, etc.). The second cellular antenna may be configured to be operable for receiving communication signals within one or more cellular frequency bands (e.g., LTE, etc.). In another example, the one or more MIMO antennas may comprise four cellular or mobile communications antennas TEL1-TEL4. Each of the antennas TEL1 to TEL4 may comprise one or more of a transmitting element (Tx) and a Receiving element (Rx). The GNSS antenna may be arranged between two of the mobile communications antennas TEL The telephony antennas may be placed on portions of the base 202 that are near an edge or over the perforations 205A, 205B, 205C of the frame 10. The satellite antennas (e.g. the GNSS antenna) may be placed on portions of the base 202 that are over a solid part of the frame. The operating frequency band of the transceivers situated at or near and edge or over the perforations may cover e.g. from about 700 MHz to 3100 MHz. It is noted that the frequency is the number of occurrences of a repeating event per unit of time. In this respect, any wave pattern can be described in terms of sinusoidal components. The wavelength of a sinusoidal wave may be the distance over which the wave's shape repeats. In this particular example, the wavelength may be between approximately 98 mm (3100 MHz) and 430 mm (700 MHz).

The perforations may comprise a rectangular shape. Each perforation may have a first dimension of between 95 mm and 200 mm along the main direction. It is noted that the first value of the first dimension (95 mm) may be considered as 0.22×□, wherein □ is the value of the wavelength (430 mm) for a limiting lowest frequency of operation of 700 MHz of the transceivers. Similarly, the first value of the second dimension (200 mm) may be considered as 0.46×□, wherein □ is the value of the wavelength (430 mm) for the limiting lowest frequency of 700 MHz of the transceivers. It is noted that the largest dimension of an antenna placed on portions of the base that are near an edge or over the perforations is determined by the lowest operational frequency of the antenna.

Each perforation may further have a second dimension of between 50 mm and 110 mm in a direction perpendicular to the main direction, respectively. Similarly, as before, the first value of the second dimension (50 mm) may be considered as 0.11×□, wherein □ is the value of the wavelength (430 mm) for the limiting lowest frequency of 700 MHz of the transceivers. The second value of the second dimension (110 mm) may be considered 0.25×□, wherein □ is the value of the wavelength (430 mm) for the limiting lowest frequency of 700 MHz of the transceivers.

Preferably, the first dimension may be between 180 mm (0.42×□) and 200 mm (0.46×□) and the second dimension between 90 mm (0.20×□) and 110 mm (0.25×□). For example, for LTE telephony antennas, such dimensions may allow for the radiation pattern and corresponding antenna gain of standard sized telephony antennas to remain within desired values for various frequencies of the LTE frequency range. It is noted that, similarly as before, □ is the value of the wavelength for the limiting lowest frequency of 700 MHz of the transceivers.

Figure 3:
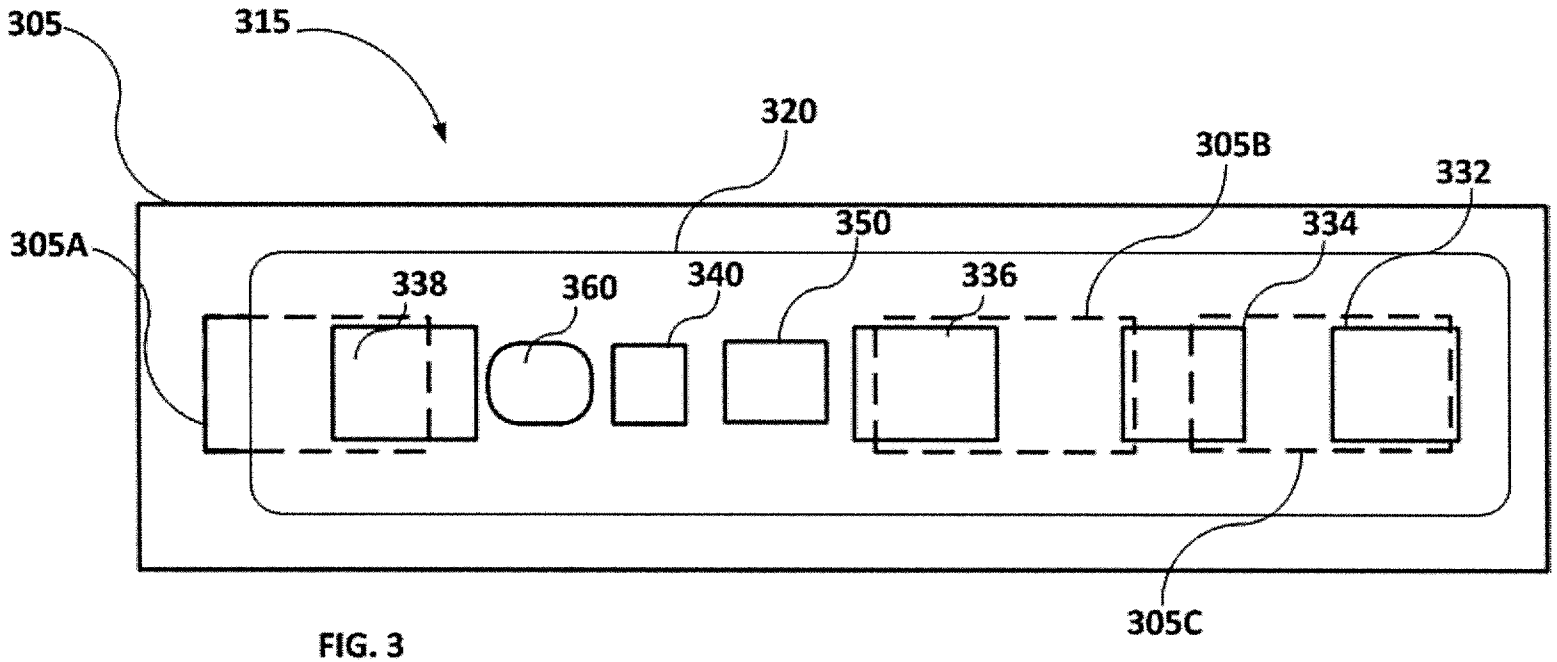
FIG. 3 schematically illustrates an under-roof module according to another example.

FIG. 3 schematically illustrates an antenna module with a 4×4 MIMO antenna, a GNSS antenna, a SDARS antenna, an RKE antenna and a communication electronic module, according to an example. Antenna module 315 may comprise a frame 305 and an elongated base 320 attached to the frame 305. The frame 305 may comprise holes 305A, 305B and 305C. The 4×4 MIMO antenna may comprise a first mobile communication antenna 332, a second mobile communication antenna 334, a third mobile communication antenna 336 and a fourth mobile communication antenna 338. The first mobile communication antenna 332 may comprise a Tx element and an Rx element. The second mobile communication antenna 334 may comprise an Rx element. The third mobile communication antenna 336 may comprise a Tx element and an Rx element. The fourth mobile communication antenna 338 may comprise an Rx element. The first mobile communication antenna 332 may be arranged at a first end of the elongated base 320 at a location corresponding to an edge of hole 305C. The second mobile communication antenna 334 may be arranged on the elongated base 320, at a location corresponding to another edge of the hole 305C. The antenna 334 may also be partially arranged at a location corresponding also to an edge of hole 305B. The third mobile communications antenna 336 may be arranged on the elongated base 320 at a location corresponding to another edge of hole 305B. The fourth mobile communication antenna 338 may be arranged on the elongated base 320 at a location corresponding to an edge of hole 305A. Thus all mobile communication antennas may be arranged on the base at locations corresponding to edges of the frame holes, allowing for unobstructed and omnidirectional radiation patterns for all terrestrial communications. The GNSS antenna 340 may be arranged on the base 320 at a location corresponding to a solid part of the frame 305, e.g. between antenna 336 and antenna 338. The SDARS antenna 350 may also be placed between the third and fourth telephony antennas, for example, between the third mobile communication antenna 336 and the GNSS antenna 340. The antenna module 315 may further comprise an RKE antenna 360. The RKE antenna 360 may be placed along the elongated base in the space between the third mobile communication antenna 336 and the fourth mobile communication antenna 338, for example, between the GNSS antenna 340 and the fourth mobile communications antenna 338. However, because the RKE antenna does not share the same spectrum as the GNSS or SDARS antennas, the RKE antenna may be placed adjacent or even on top of the GNSS or the SDARS antenna. In the example of FIG. 3 the elongated base may be at least 530 mm long to accommodate the seven antennas and a communication electronic module (not shown). Each hole may be, for example, 190 mm long and 100 mm wide. However other hole dimensions are possible.

FIGS. 4A-4E schematically illustrates a transceiver at five different distances d with respect a perforation of a metallic frame according to an example. A distance (d) may be defined as a distance between an excitation point 400*a* of a transceiver 400 and an edge 401*a* of the hole 401. As will be described below, the VSWR may be influenced by the distance d.

It is noted that the VSWR may be between 1 and 4 for a "desirable range of operation". Particularly, the VSWR may be above 1 and below 3 for an "optimum range of operation" of the transceiver. The VSWR may be between 3 and 4 for an "acceptable range of operation" of operation.

Figure 4A:
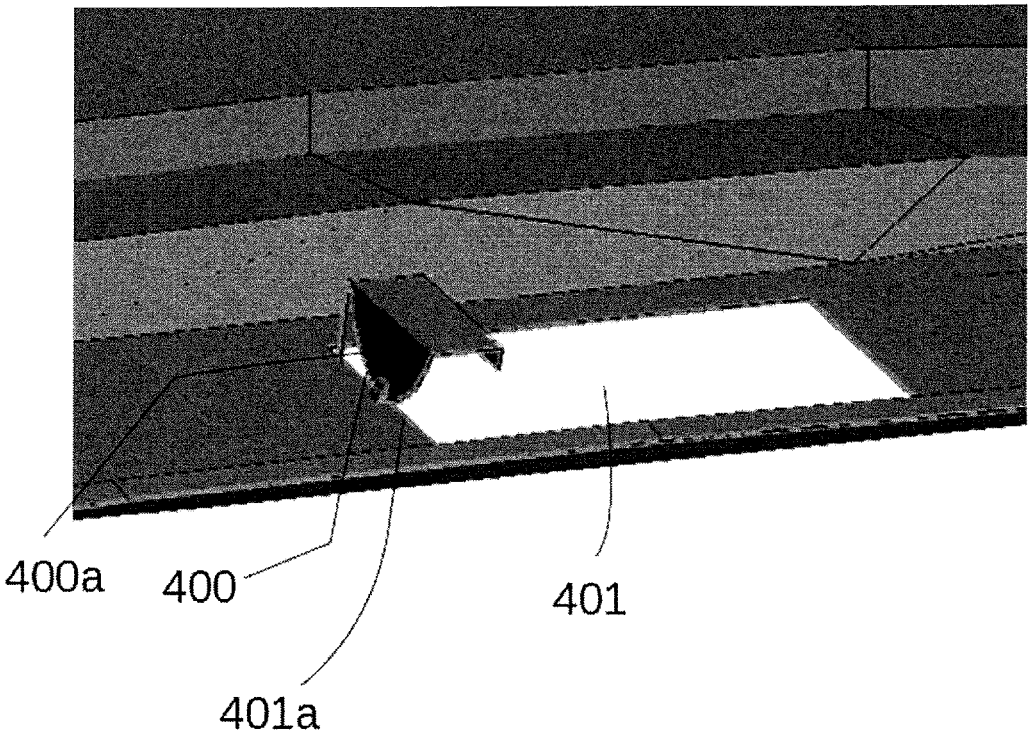
FIGS. 4*a*-4*e* schematically illustrates a transceiver at five different distances (d) with respect a perforation of a metallic frame according to an example.

In FIG. 4A, the distance (d) may be 0 mm i.e. the excitation point 400*a* of the transceiver 400 may be located at the edge 401*a* of the hole 401. The LTE frequencies of the transceiver may be situated between 700 and 950 MHz, between 1700 and 2100 MHz and between 2500 MHz and 2700 MHz. At these operational frequencies, the VSWR may range between 1.3 (at a transceiver frequency of 2100 MHz) and 2.9 (at a transceiver frequency of 950 MHz). The VSWR may thus be within the "optimum range of operation".

Figure 4B:
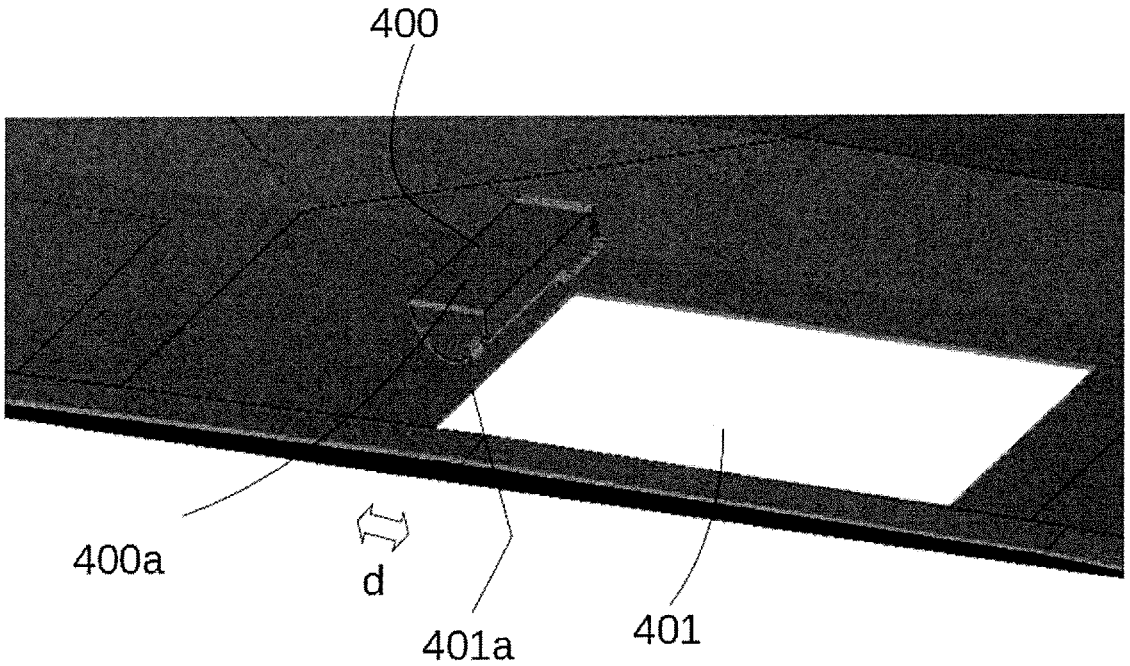

In FIG. 4B, the distance (d) may be 10 mm i.e. the excitation point 400*a* of the transceiver 400 may be located at a distance (d) of 10 mm with respect to the edge 401*a* of the hole 401. The LTE frequencies of the transceiver may be situated between 700 and 950 MHz, between 1700 and 2100 MHz and between 2500 MHz and 2700 MHz. At these operational frequencies, the VSWR may range between 1.4 (at a transceiver frequency of 1700 MHz) and 2.6 (at a transceiver frequency of 700 MHz). The VSWR may thus be again within the "optimum range of operation".

Figure 4C:
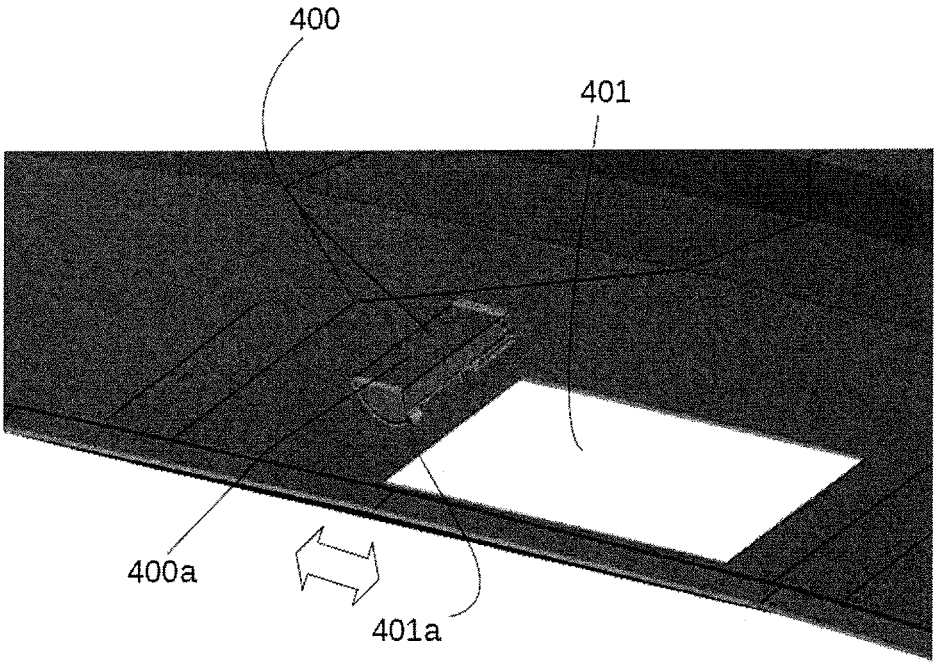

In FIG. 4C, the distance (d) may be 20 mm i.e. the excitation point 400*a* of the transceiver 400 may be located at a distance of 20 mm with respect to the end 401*a* of the hole 401. The LTE frequencies of the transceiver may be situated between 700 and 950 MHz, between 1700 and 2100 MHz and between 2500 MHz and 2700 MHz. At these operational frequencies, the VSWR may range between 1.6 (at a transceiver frequency of 2700 MHz) and 2.9 (at a transceiver frequency of 700 MHz). Similarly, as before, the VSWR may be within the "optimum range of operation" for every LTE frequency of the transceiver.

Figure 4D:
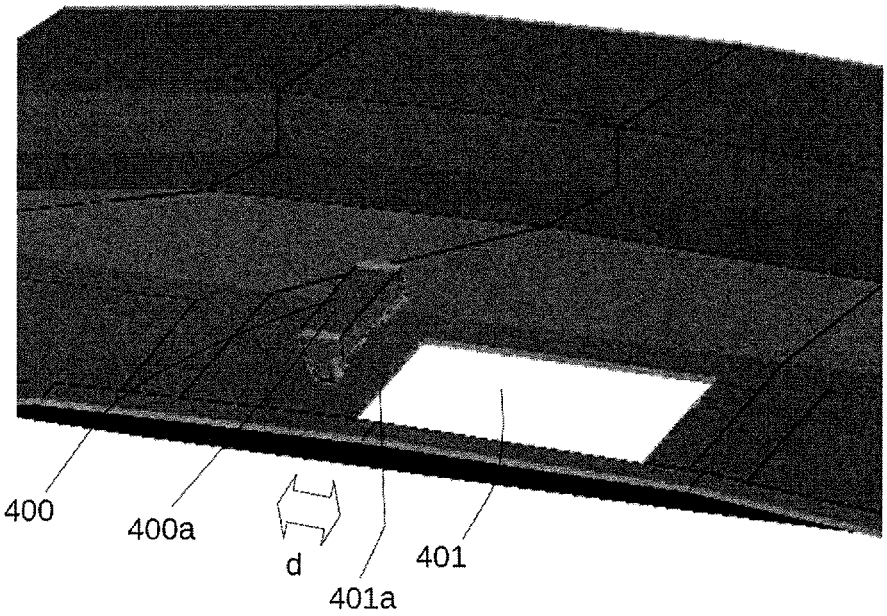

In FIG. 4D, the distance (d) may be 30 mm i.e. the excitation point 400*a* of the transceiver 400 may be located at a distance of 30 mm with respect to the edge 401*a* of the hole 401. The LTE frequencies of the transceiver may be situated between 700 and 950 MHz, between 1700 and 2100 MHz and between 2500 MHz and 2700 MHz. At these operational frequencies, the VSWR may range between 1.5 (at a transceiver frequency of 2700 MHz) and 3.1 (at a transceiver frequency of 700 MHz). Therefore, at some frequencies of the transceiver, the VSWR may still be within the "optimum range of operation". However, at some other frequencies of the transceiver e.g. at 700 MHz, the VSMR may be within the "acceptable range of operation".

Figure 4E:
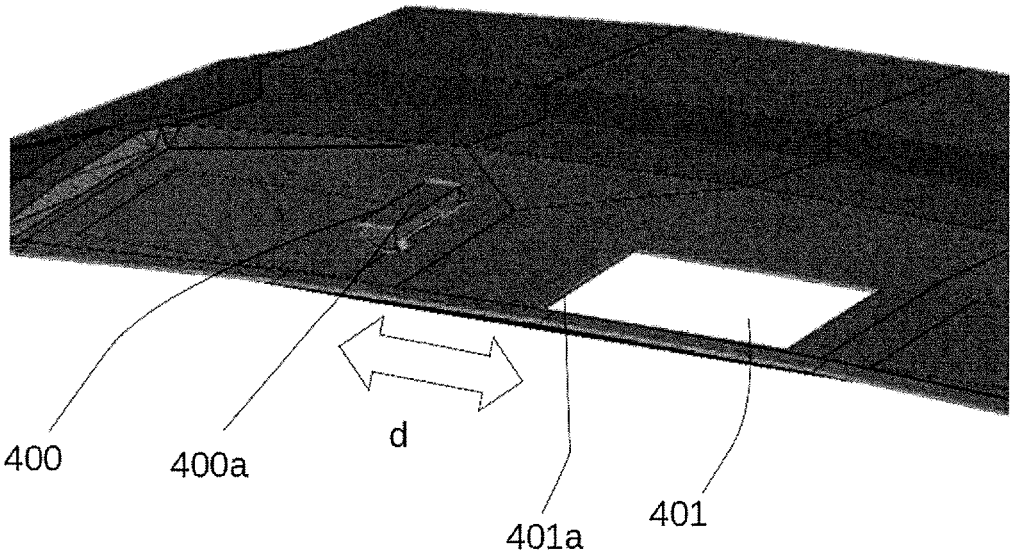

In FIG. 4E, the distance (d) may be 140 mm i.e. the excitation point 400*a* of the transceiver 400 may be located at a distance of 140 mm with respect to the edge 401*a* of the hole 401. Similarly, as in previous examples, the LTE frequencies of the transceiver may be situated between 700 and 950 MHz, between 1700 and 2100 MHz and between 2500 MHz and 2700 MHz. At these frequencies, the VSWR may range between 1.5 (at a transceiver frequency of 2600 MHz) and 6 (at a transceiver frequency of 700 MHz).

Therefore, at some frequencies of the transceiver, the VSWR may still be within the "optimum range of operation". However, at a transceiver's frequency of 700 MHz, the VSWR may be around 6. The VSWR may thus be in a "non-acceptable range of operation" for some of the frequencies.

It is thus clear that, for a similar transceiver's frequency of e.g. 700 MHz, by reducing the distance (d) between the receivers and the hole, the VSWR may also be reduced, thus improving the performance of the receiver. On the contrary, as the distance between the receiver and the hole is increased, the receiver's impedance is decreased and the VSWR value may be outside specification.

In summary, the values of the distance (d) between the receiver and the hole for a proper functioning of the receiver may be the following:

Optimum distance (d) values i.e. values of the distance (d) providing a VSWR below 3 may be between 0 and 40 mm;

Acceptable distance (d) values i.e. values of distance (d) providing a VSWR between 3 and 4 may be a range of values between 40 mm and 70 mm;

Non-acceptable distance (d) values i.e. values of distance d providing a VSWR above 4 may be distance values above 70 mm.

It is further noted that for a range of transceiver's frequencies between approximately between 1750 MHz and 2200 MHz and a further range of transceiver's frequencies between 2350 MHz and 3000 MHz, the VSWR may always be in an optimum range of operation independently of the distance (d).

FIG. 5A-5E schematically illustrates five different widths (w) of a hole of a perforation forming part of a metallic frame of an under-roof antenna module according to an example. The width (w) of a hole 401 may be defined as a distance between a first end 404 and a second end 405 of the hole 401. As will be described below, the VSWR may be influenced by the width w of the hole.

Similarly, as before, it is noted that the VSWR may be between 1 and 4 for a "desirable range of operation". Particularly, the VSWR may be above 1 and below 3 for an "optimum range of operation" of the transceiver. VSWR may be between 3 and 4 for an "acceptable range of operation" of operation. It is further noted that, in all the examples, the distance (d) of the receiver with respect of the hole, as hereinbefore described, may be 0 mm.

Figure 5A:
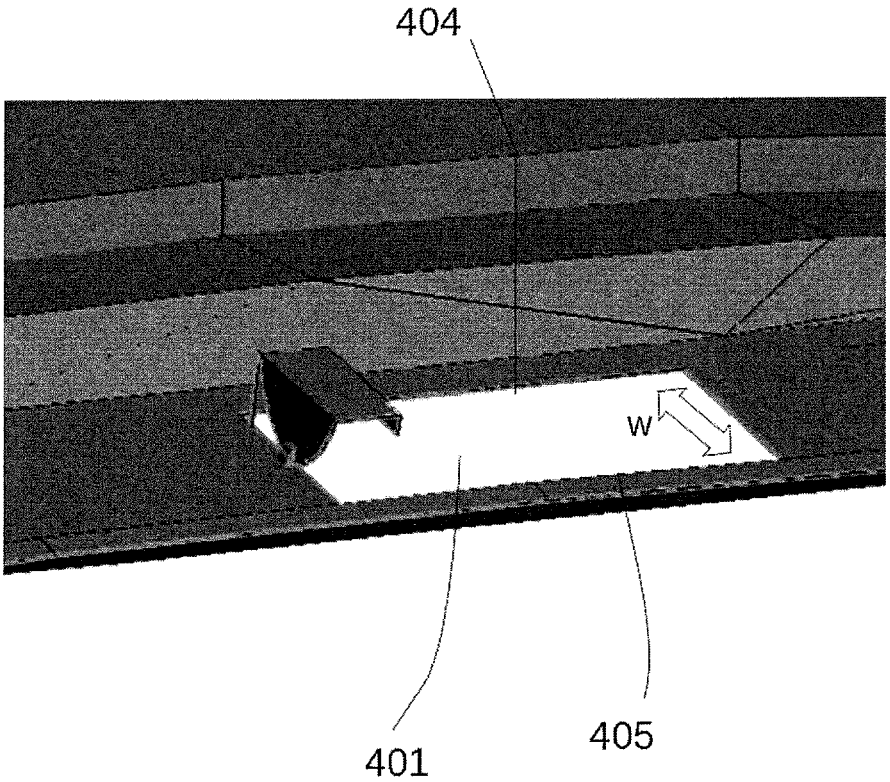
FIGS. 5*a*-5*e* schematically illustrates five different widths (w) of a hole of a perforation forming part of a metallic frame of an under-roof antenna module according to an example.

In FIG. 5A, the width (w) of the hole may be 100 mm. The LTE frequencies of the transceiver may be situated between 700 and 950 MHz, between 1700 and 2100 MHz and between 2500 MHz and 2700 MHz. At these operational frequencies, the VSWR may range between 1.3 (at a transceiver frequency of 2100 MHz) and 2.8 (at a transceiver frequency of 950 MHz). The VSWR may thus be within the "optimum range of operation".

Figure 5B:
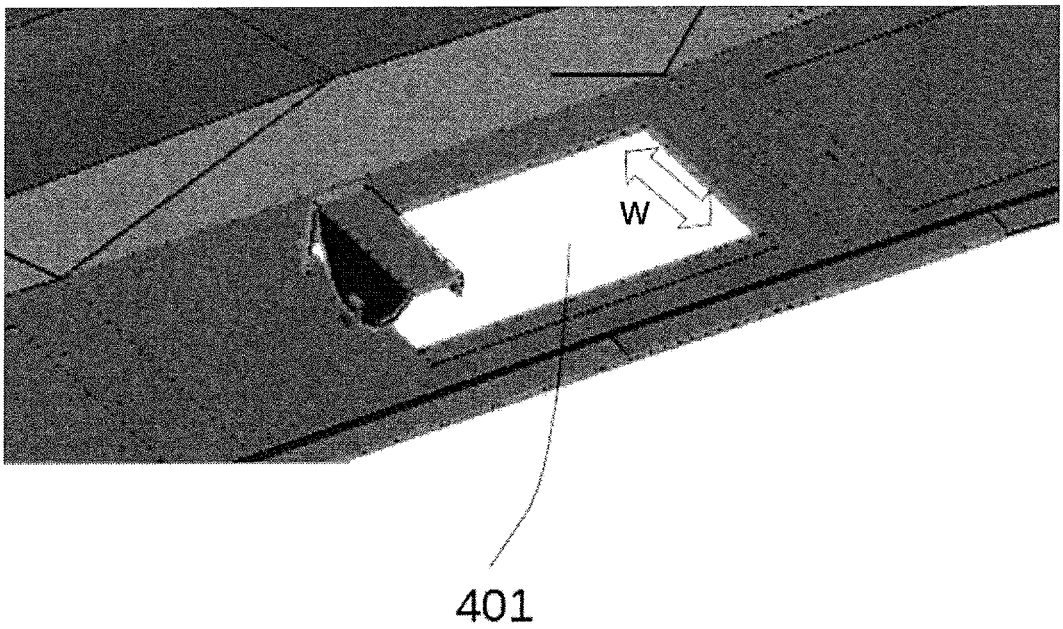

In FIG. 5B, the width (w) of the hole may be 90 mm. The LTE frequencies of the transceiver may be situated between 700 and 950 MHz, between 1700 and 2100 MHz and between 2500 MHz and 2700 MHz. At these operational frequencies, the VSWR may range between 1.4 (at a transceiver frequency of 1900 MHz) and 3 (at a transceiver frequency of 700 MHz). The VSWR may thus be within the "optimum range of operation" for some of the frequencies. However, for the transceiver frequency of 700 MHz, the VSMR may be outside the "optimum range of operation" and within the "acceptable range of operation"

Figure 5C:
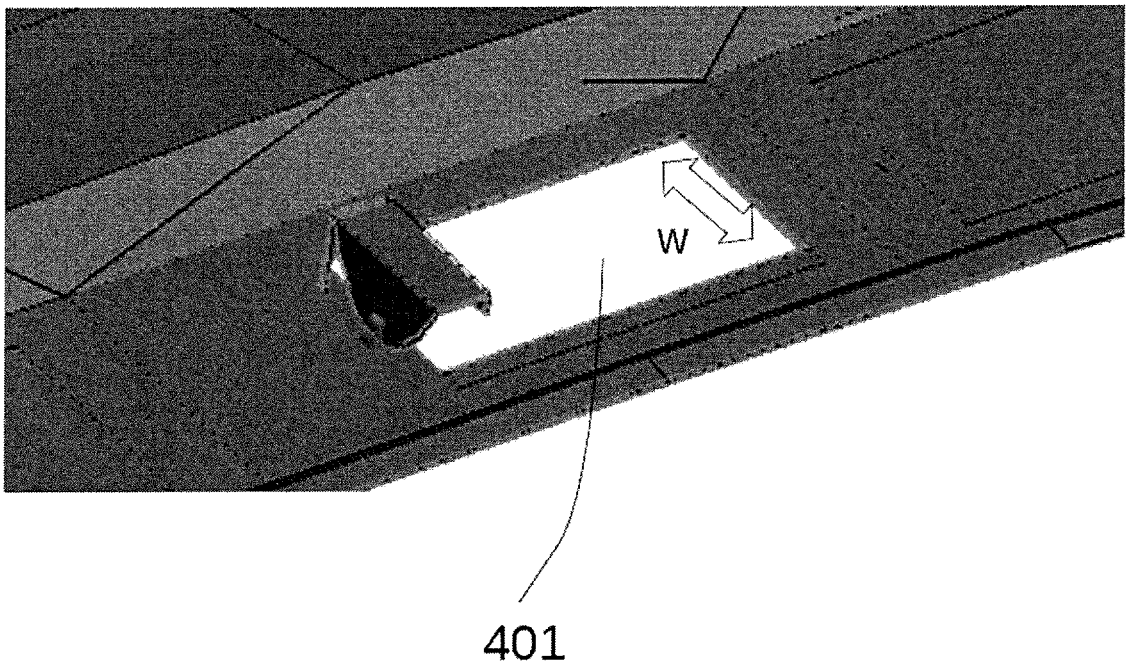

In FIG. 5C, the width (w) of the hole may be 80 mm. The LTE frequencies of the transceiver may be situated between 700 and 950 MHz, between 1700 and 2100 MHz and between 2500 MHz and 2700 MHz. At these operational frequencies, the VSWR may range between 1.5 (at the transceiver frequency of 1900 MHz) and 3.3 (at a transceiver frequency of 700 MHz).

Therefore, at a transceiver's frequency of 700 MHz, the VSWR may be around 3.3. The VSWR may thus be outside the "optimum range of operation" but within the "acceptable range of operation".

Figure 5D:
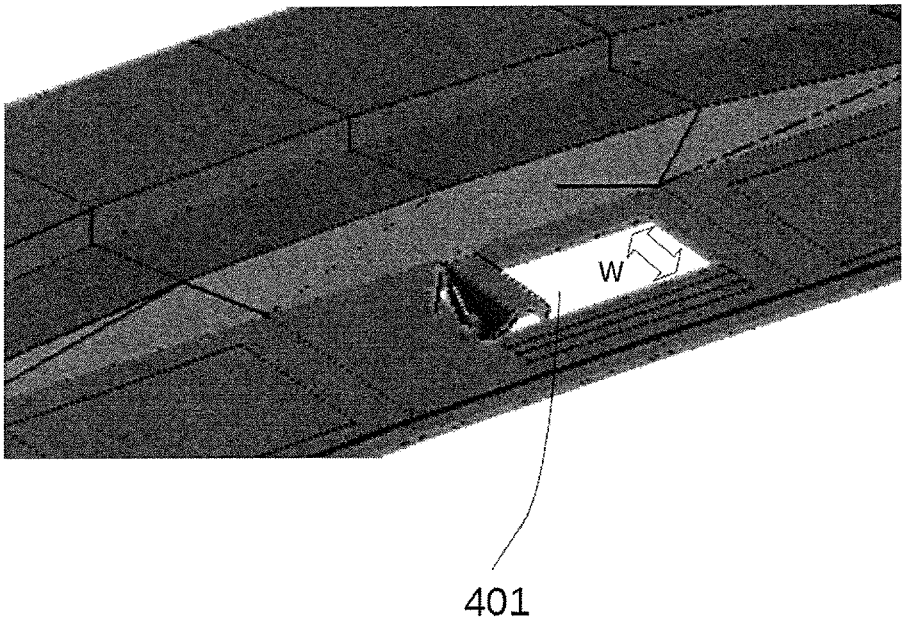

In FIG. 5D, the width (w) of the hole may be 70 mm. The LTE frequencies of the transceiver may be situated between 700 and 950 MHz, between 1700 and 2100 MHz and between 2500 MHz and 2700 MHz. At these operational frequencies, the VSWR may range between 1.6 (at a transceiver frequency of 2000 MHz) and 3.7 (at a transceiver frequency of 700 MHz).

Therefore, at a transceiver's frequency of 700 MHz, the VSWR may be around 3.7. Again, the VSWR may be outside the "optimum range of operation" but within the "acceptable range of operation" for some of the frequencies of the transceiver.

Figure 5E:
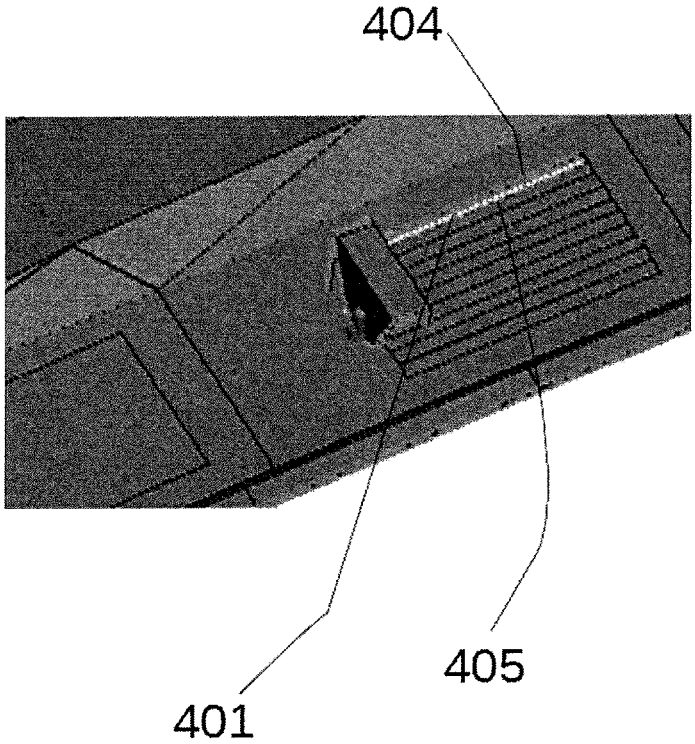

In FIG. 5E, the width (w) of the hole may be 10 mm i.e. the distance between the end 404 and the end 405 may be 10 mm. The LTE frequencies of the transceiver may be situated between 700 and 950 MHz, between 1700 and 2100 MHz and between 2500 MHz and 2700 MHz. At these operational frequency ranges, the VSWR may range between 1.6 (at the transceiver frequency of 2600 MHz) and 6 (at a transceiver frequency of 700 MHz).

Therefore, at a transceiver's frequency of 700 MHz, the VSWR may be around 6. The VSWR may thus be within the "non-acceptable range of operation".

It is thus clear that the effect of a reduction in the width (w) of the hole, for a similar receiver's frequency, is generally that the VSWR is increased such that the performance of the receiver is reduced. On the contrary, the effect of an increase in the width (w) of the hole, for a similar receiver's frequency, is generally that the VSWR is reduced such that the overall performance of the receiver is improved.

In summary, the values of the width (w) of the hole for a properly operation of the receiver may be the following:

Optimum width (w) values i.e. for a VSWR below 3 may be above 100 mm and below 80 mm;

Acceptable width (w) values i.e. for a VSWR between 3 and 4 may be a range between 80 mm and 50 mm;

Non-acceptable distance (d) values i.e. values for a VSWR value above 4 may be distance values above 50 mm.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples but should be determined only by a fair reading of the claims that follow. If reference signs related to drawings are placed in parentheses in a claim, they are solely for attempting to increase the intelligibility of the claim and shall not be construed as limiting the scope of the claim.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. An under-roof antenna module for a vehicle, comprising:

a metallic frame with at least one perforation;

at least one transceiver arranged at portions of the frame proximal to the at least one perforation; and at least a second transceiver arranged at portions of the frame distal to the perforations, and further away from the perforations than the at least one transceiver.

2. The under-roof antenna module according to claim 1, wherein the at least second transceiver comprises satellite antennas.

3. An under-roof antenna module for a vehicle, comprising:

metallic frame with at least one perforation; and at least one transceiver, arranged at portions of the frame proximal to the at least one perforation, wherein the under-roof antenna module is adapted to be placed in a recession of a roof portion of the vehicle.

4. The under-roof antenna module according to claim 3, wherein the metallic frame is integrated with the roof portion of the vehicle.

5. The under-roof antenna module according to claim 1, further comprising:

a support base, attached to the metallic frame, wherein at least one of the at least one transceiver and the at least second transceiver are arranged along the support base.

6. An under-roof antenna module for a vehicle, comprising:

a metallic frame with at least one perforation; and at least one transceiver, arranged at portions of the frame proximal to the at least one perforation, wherein the metallic frame has an elongated form along a main direction and a series of perforations along the first direction, and wherein the elongated frame comprises three perforations distributed along the elongated form, one central perforation and two extreme perforations wherein the central perforation is towards the center of the frame and the extreme perforations are towards the edges of the elongated frame and wherein a first cellular telephony antenna is attached at an edge of an extreme perforation, a second cellular telephony antenna is attached at an edge of the other extreme perforation and a third and fourth telephony antennas are attached at a first and second edge of the central perforation, respectively.

7. The under-roof antenna module according to claim 6, further comprising:

a remote keyless entry (RKE) antenna attached to another edge of one of the extreme perforations.

8. The under-roof antenna module according to claim 6, wherein the perforations comprise a rectangular shape, each having a first dimension of between 95 and 200 mm along the main direction and a second dimension of between 50 mm and 110 mm in a direction perpendicular to the main direction, respectively.

9. An under-roof antenna module for a vehicle, comprising:

a metallic frame with at least one perforation; and at least one transceiver, arranged at portions of the frame proximal to the at least one perforation, wherein an operating frequency band of the transceiver covers from 700 MHz to 3100 MHz, and wherein a distance between an edge of the at least one perforation and the portions of the frame proximal to such perforations is below 70 mm.

10. The under-roof antenna module according to claim 2, further comprising:

a support base, attached to the metallic frame, wherein at least one of the at least one transceiver and the at least second transceiver are arranged along the support base.

11. The under-roof antenna module according to claim 5, wherein the metallic frame has an elongated form along a main direction and a series of perforations along the first direction.

12. The under-roof antenna module according to claim 7, wherein the perforations comprise a rectangular shape, each having a first dimension of between 95 and 200 mm along the main direction and a second dimension of between 50 mm and 110 mm in a direction perpendicular to the main direction, respectively.

13. The under-roof antenna module according to claim 8, wherein an operating frequency band of the transceiver covers from 700 MHz to 3100 MHz.

14. An under-roof antenna module for a vehicle, comprising:

a metallic frame with a plurality of perforations spaced side-by-side;

a base attached to the metallic frame and extending over the plurality of perforations;

at least one terrestrial communication transceiver attached to the base and disposed at a respective perforation of the plurality of perforations; and at least one satellite communication transceiver attached to the base and disposed away from the plurality of perforations and at the metallic frame.

* * * * *